US008734275B2

(12) United States Patent
Orenstein

(10) Patent No.: US 8,734,275 B2
(45) Date of Patent: May 27, 2014

(54) PORTABLE GOAL ASSEMBLY

(75) Inventor: Amber Orenstein, Prior Lake, MN (US)

(73) Assignee: The Prophet Corporation, Owatonna, MN (US)

( * ) Notice: Subject to any disclaimer, the term of this patent is extended or adjusted under 35 U.S.C. 154(b) by 165 days.

(21) Appl. No.: 13/315,672

(22) Filed: Dec. 9, 2011

(65) Prior Publication Data

US 2012/0184400 A1 Jul. 19, 2012

Related U.S. Application Data

(60) Provisional application No. 61/421,762, filed on Dec. 10, 2010.

(51) Int. Cl.
*A63B 63/00* (2006.01)

(52) U.S. Cl.
USPC ..... 473/478; 273/400

(58) Field of Classification Search
USPC ..... 273/398–402, 395, 396; 473/476–478, 473/481, 434, 435, 454–456, 197; 16/18, 16/19, 32, 40, 43
See application file for complete search history.

(56) References Cited

U.S. PATENT DOCUMENTS

| | | | | | |
|---|---|---|---|---|---|
| 2,133,423 | A | * | 10/1938 | Burrow | 16/21 |
| 2,998,663 | A | * | 9/1961 | Boardman et al. | 108/117 |
| 3,069,719 | A | * | 12/1962 | Ridge | 16/30 |
| 4,748,715 | A | * | 6/1988 | Rice | 16/19 |
| 5,064,194 | A | * | 11/1991 | Bixler et al. | 473/436 |
| 5,186,469 | A | | 2/1993 | Terris | |
| 5,273,292 | A | * | 12/1993 | Pardi et al. | 273/400 |
| 5,431,411 | A | | 7/1995 | Padilla | |
| 5,533,733 | A | | 7/1996 | Dirnbeck | |
| 5,566,952 | A | | 10/1996 | Mullin et al. | |
| 5,749,121 | A | * | 5/1998 | Loescher | 16/43 |
| 5,833,234 | A | * | 11/1998 | Vavala et al. | 473/434 |
| 5,842,939 | A | | 12/1998 | Pui et al. | |
| 6,375,585 | B1 | * | 4/2002 | Driscoll | 473/477 |
| 6,558,279 | B1 | | 5/2003 | Goldwitz | |
| 6,629,900 | B2 | | 10/2003 | Wu | |

(Continued)

FOREIGN PATENT DOCUMENTS

CN 2792562 7/2006

OTHER PUBLICATIONS

Gopher Catalog, front cover, pp. 82-83 and 156-159 (2001).

(Continued)

*Primary Examiner* — Mark Graham
(74) *Attorney, Agent, or Firm* — Merchant & Gould P.C.

(57) ABSTRACT

A goal assembly includes a base frame and a main frame. The base frame includes a first side rail, a second side rail and a cross-member that is engaged to the first and second side rails. The main frame includes a first side leg engaged to the first side rail, a second side leg engaged to the second side rail, and a cross-bar engaged to the first and second side legs. A first wheel assembly is engaged to the first side rail. The first wheel assembly includes a wheel that rotates about a rotation axis of the first wheel assembly. A second wheel assembly is engaged to the first side rail. The second wheel assembly includes a wheel that rotates about a rotation axis of the second wheel assembly. The rotation axes of the first and second wheel assemblies are generally parallel to the first side rail.

29 Claims, 12 Drawing Sheets

(56) References Cited

U.S. PATENT DOCUMENTS

| | | | | |
|---|---|---|---|---|
| 6,761,644 | B1 * | 7/2004 | Aubert | 473/197 |
| 7,371,195 | B2 * | 5/2008 | Stevens | 473/478 |
| 2007/0176369 | A1 * | 8/2007 | Sellke | 273/407 |
| 2008/0042023 | A1 * | 2/2008 | Williams | 248/188.1 |
| 2008/0132361 | A1 * | 6/2008 | Barber | 473/439 |
| 2010/0029416 | A1 * | 2/2010 | Lindstrom | 473/477 |
| 2010/0062880 | A1 * | 3/2010 | Hayes | 473/422 |
| 2011/0140363 | A1 * | 6/2011 | Gravel | 273/406 |
| 2011/0275461 | A1 * | 11/2011 | Pastore | 473/478 |
| 2012/0252606 | A1 * | 10/2012 | Ennis | 473/478 |

OTHER PUBLICATIONS

Gopher Catalog, front cover, pp. 137, 140-141, and 203-207 (Fall 2006).

Gopher Catalog, front cover, pp. 154, 155 and 218-223 (Spring 2010).

* cited by examiner

PORTABLE GOAL ASSEMBLY

CROSS REFERENCE TO RELATED APPLICATION

This application claims the benefit of U.S. Provisional Patent Application Ser. No. 61/421,762, filed Dec. 10, 2010, which application is hereby incorporated by reference in its entirety.

BACKGROUND

Hockey and soccer are popular sports that are played and enjoyed by children and adults. Many recreational facilities offer recreational and competitive game play. Given the popularity of these sports, there is a need for a goal that can be easily transported on and off the field of play.

SUMMARY

An aspect of the present disclosure relates to a goal assembly. The goal assembly includes a base frame and a main frame engaged to the base frame. The base frame includes a first side rail, a second side rail that is generally parallel to the first side rail and a cross-member that is engaged to the first and second side rails. The main frame extends in a generally upward direction. The main frame includes a first side leg engaged to the first side rail, a second side leg engaged to the second side rail, and a cross-bar engaged to the first and second side legs. A first wheel assembly is engaged to the first side rail. The first wheel assembly includes a wheel that rotates about a rotation axis of the first wheel assembly. A second wheel assembly is engaged to the first side rail. The second wheel assembly includes a wheel that rotates about a rotation axis of the second wheel assembly. The rotation axes of the first and second wheel assemblies are generally parallel to the first side rail.

Another aspect of the present disclosure relates to a goal assembly. The goal assembly includes a base frame, a main frame engaged to the base frame and a shelf. The base frame includes a first side rail, a second side rail that is generally parallel to the first side rail and a cross-member that is engaged to the first and second side rails. The main frame extends in a generally perpendicular direction to the base frame. The main frame includes a first side leg engaged to the first side rail, a second side leg engaged to the second side rail, and a cross-bar engaged to the first and second side legs. The shelf is engaged to the cross-bar of the main frame. The shelf has a first end portion, a second end portion that is generally parallel to the first end portion and a body portion that extends between the first and second end portions. The body portion is generally parallel to the cross-bar of the main frame. A net is engaged to the base frame and the main frame. A first wheel assembly is engaged to the first side rail. The first wheel assembly includes a wheel that rotates about a rotation axis of the first wheel assembly. A second wheel assembly is engaged to the first side rail. The second wheel assembly includes a wheel that rotates about a rotation axis of the second wheel assembly. The rotation axes of the first and second wheel assemblies are generally parallel to the first side rail.

Another aspect of the present disclosure relates to a goal assembly. The goal assembly includes a main frame, a base frame pivotally engaged with the main frame, and a shelf pivotally engaged with the main frame. The main frame includes a first side leg, a second side leg that is parallel to the first side leg and a cross-bar engaged to the first and second side legs. The first and second side legs defining a scoring plane. The base frame is adapted to pivot between an open position and a closed position. The base frame having a first side rail engaged to the first side leg, a second side rail engaged to the second side leg, the second side rail being generally parallel to the first side rail. A cross-member engaged to the first and second side rails. The shelf is pivotally engaged to the cross-bar of the main frame and is adapted to pivot between an open position and a closed position. The shelf has a first end portion, a second end portion that is parallel to the first end portion and a body portion that extends between the first and second end portions. The body portion is generally parallel to the cross-bar of the main frame. A net is engaged to the base frame and the main frame. A first wheel assembly is engaged to the first side rail. The first wheel assembly has a wheel that rotates about a rotation axis of the first wheel assembly. A second wheel assembly is engaged to the first side rail. The second wheel assembly has a wheel that rotates about a rotation axis of the second wheel assembly. The rotation axes of the first and second wheel assemblies are generally perpendicular to the scoring plane.

Another aspect of the present disclosure relates to a goal assembly. The goal assembly includes a frame assembly having a first side leg, a second side leg that is parallel to the first side leg and a cross-bar engaged to the first and second side legs. The first and second side legs defining a scoring plane. A first wheel assembly is engaged to the frame assembly. The first wheel assembly has a wheel that rotates about a rotation axis of the first wheel assembly. A second wheel assembly is engaged to the frame assembly. The second wheel assembly has a wheel that rotates about a rotation axis of the second wheel assembly. The rotation axes of the first and second wheel assemblies are generally perpendicular to the scoring plane.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
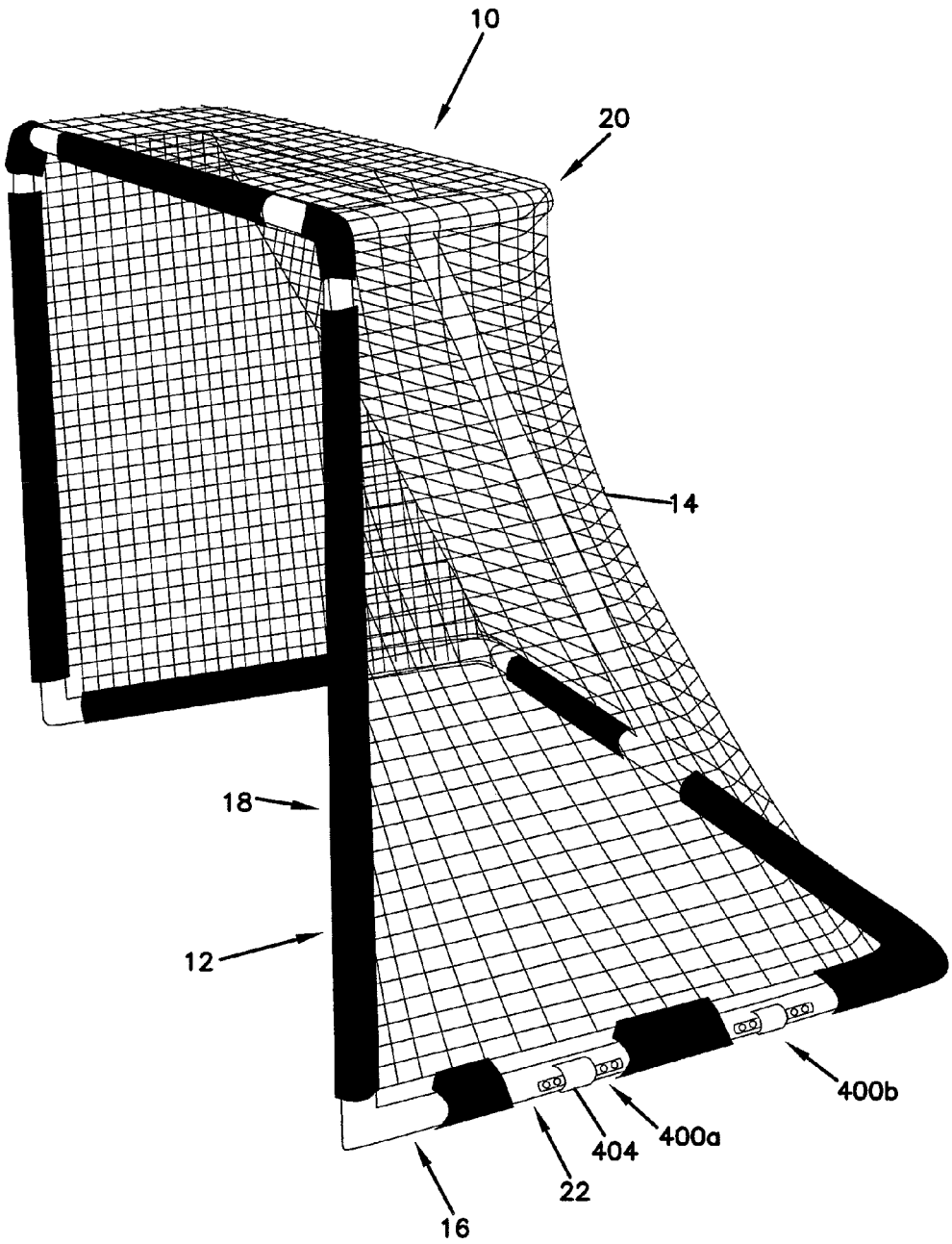
FIG. 1 is a perspective view of a goal assembly having exemplary features of aspects in accordance with the principles of the present disclosure.
Figure 2:
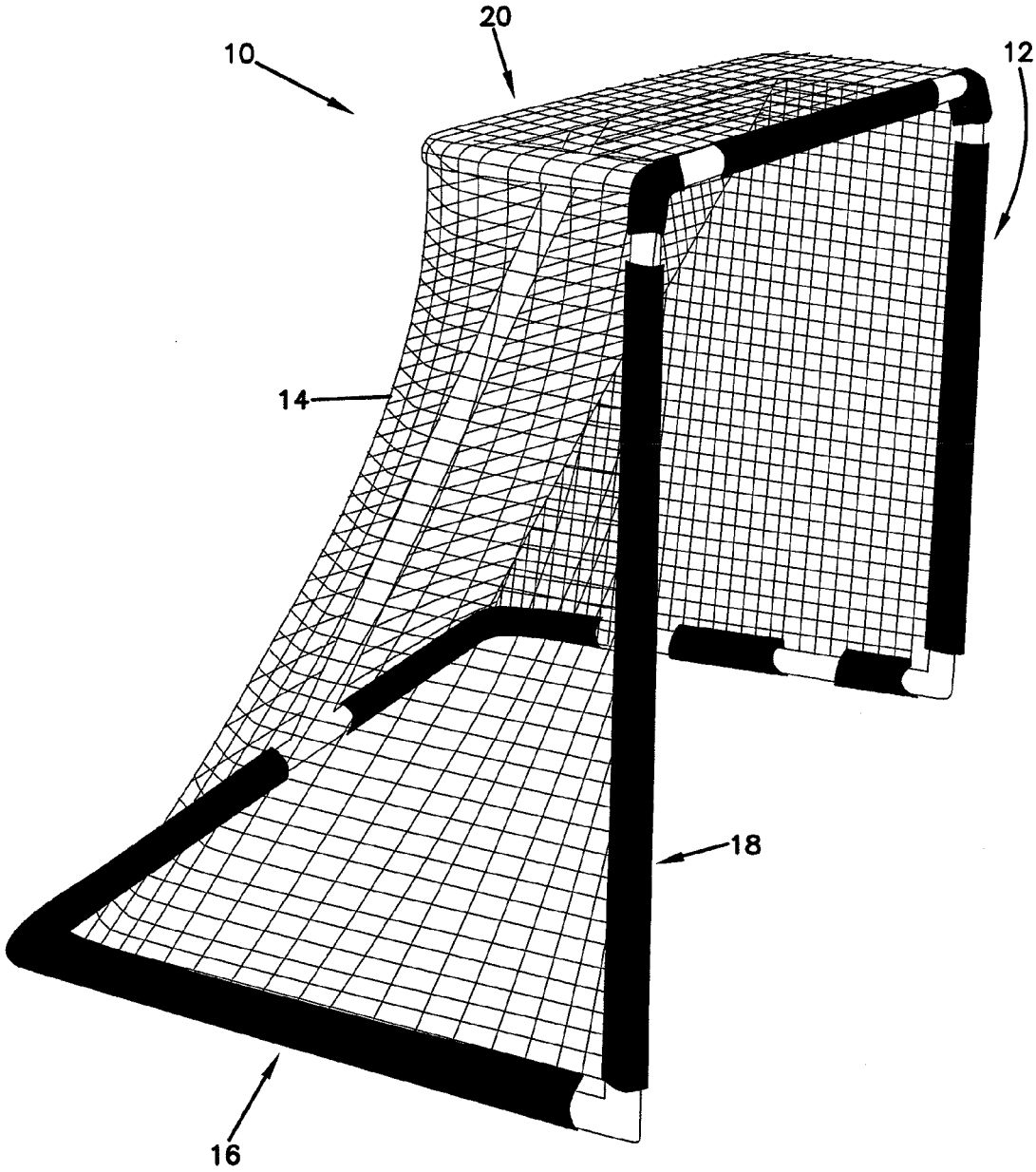
FIG. 2 is a perspective view of the goal assembly of FIG. 1.
Figure 3:
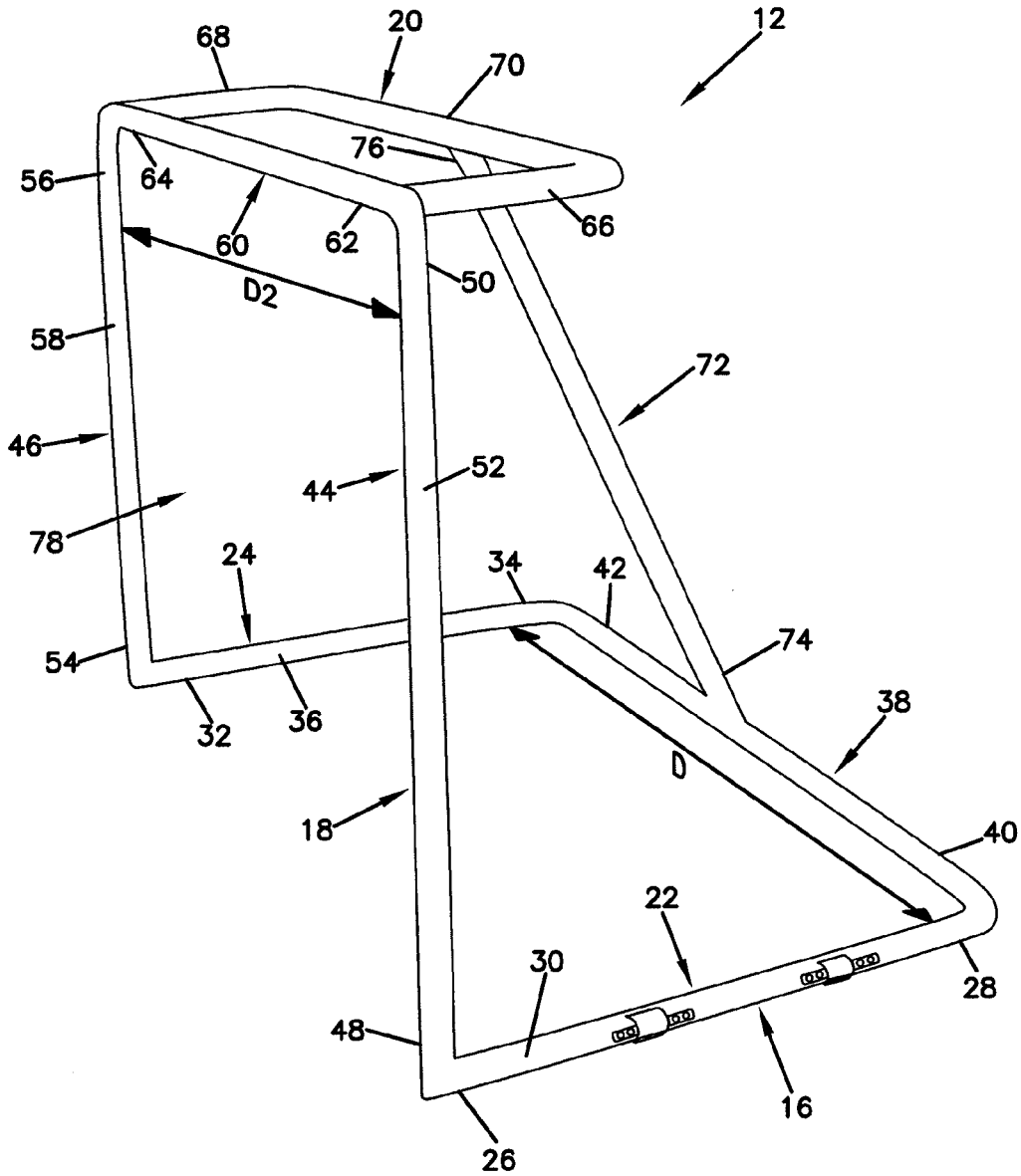
FIG. 3 is a perspective view of a frame assembly suitable for use with the goal assembly of FIG. 1.
Figure 4:
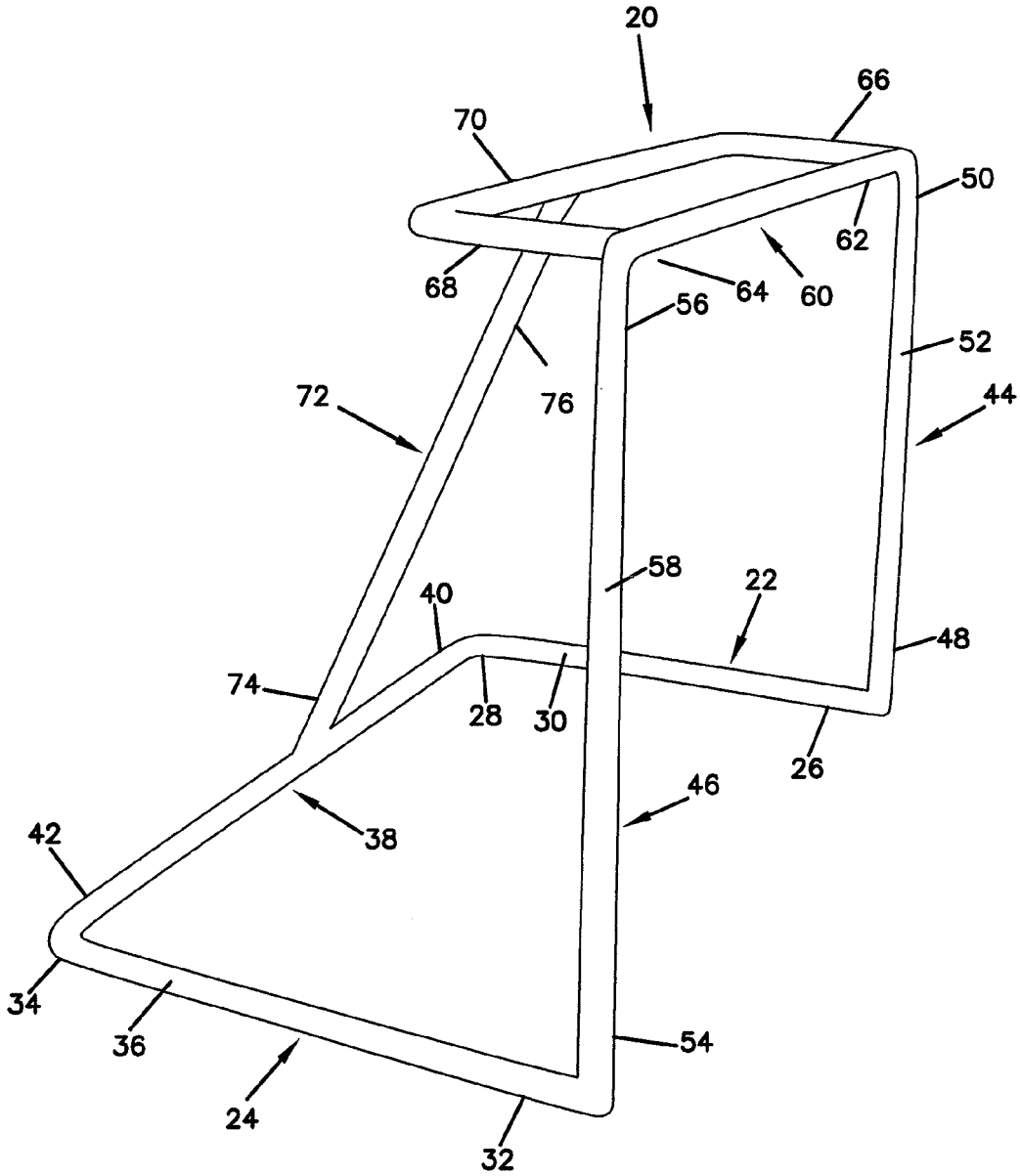
FIG. 4 is a perspective view of the frame assembly of FIG. 3.
Figure 5:
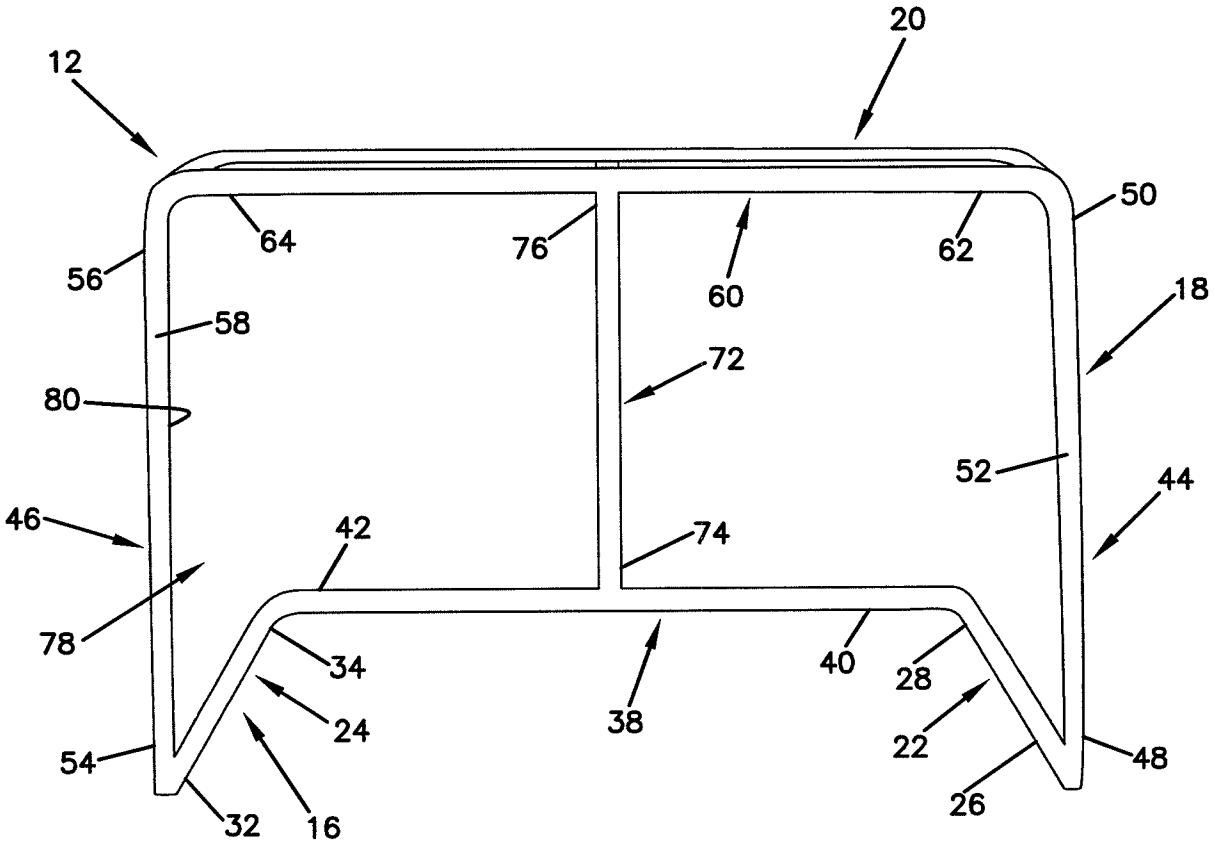
FIG. 5 is a front view of the frame assembly of FIG. 3.
Figure 6:
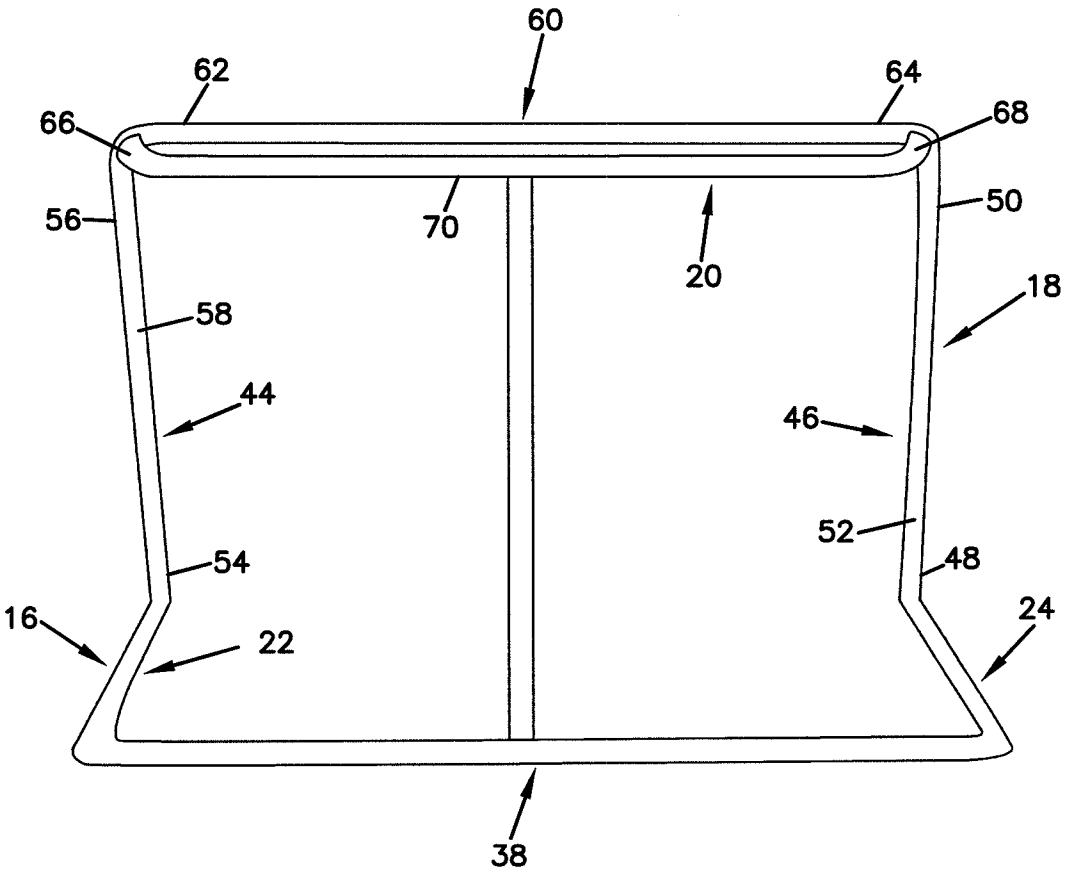
FIG. 6 is a rear view of the frame assembly of FIG. 3.
Figure 7:
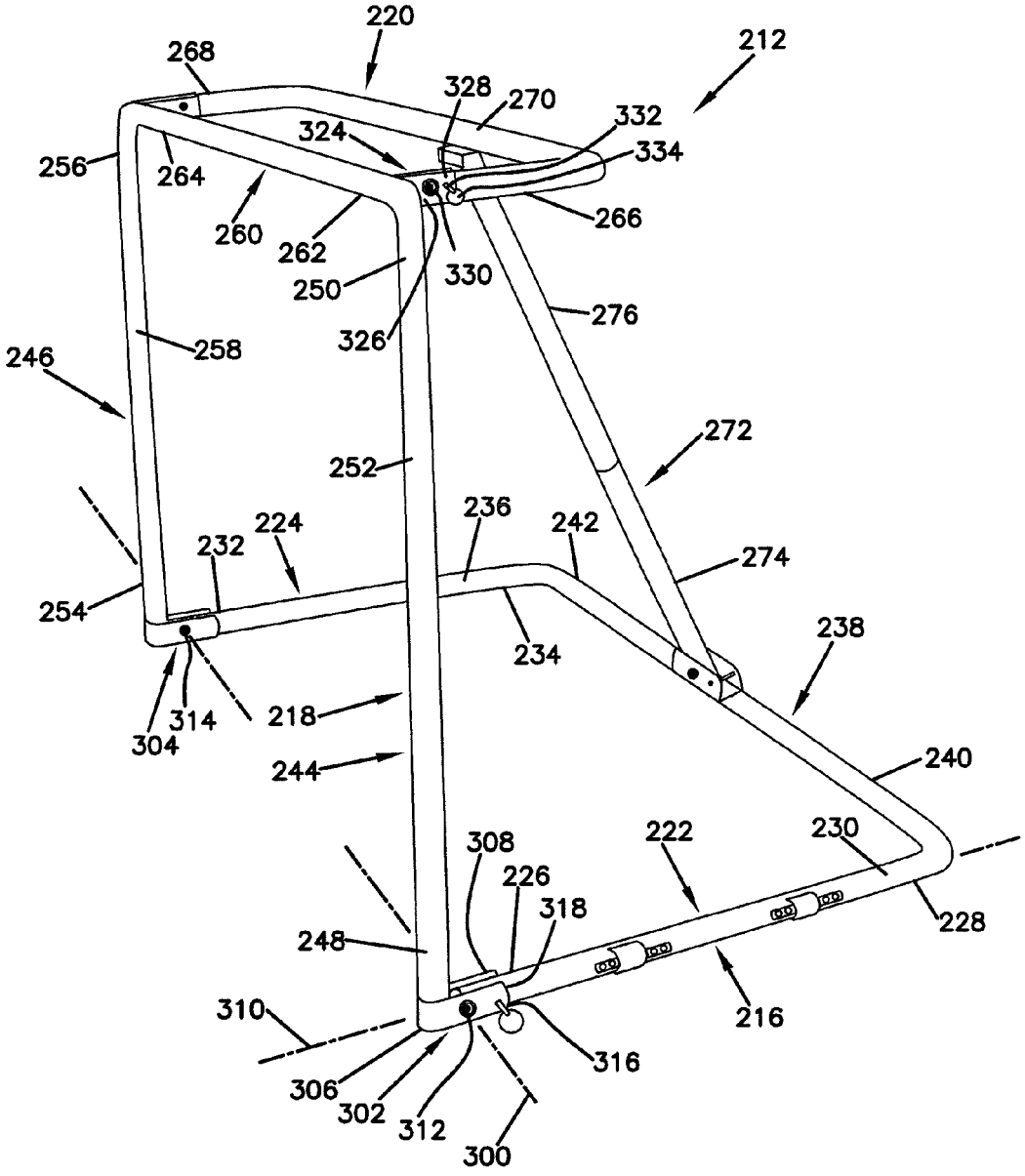
FIG. 7 is a perspective view of an alternate embodiment of a frame assembly suitable for use with the goal assembly of FIG. 1.
Figure 8:
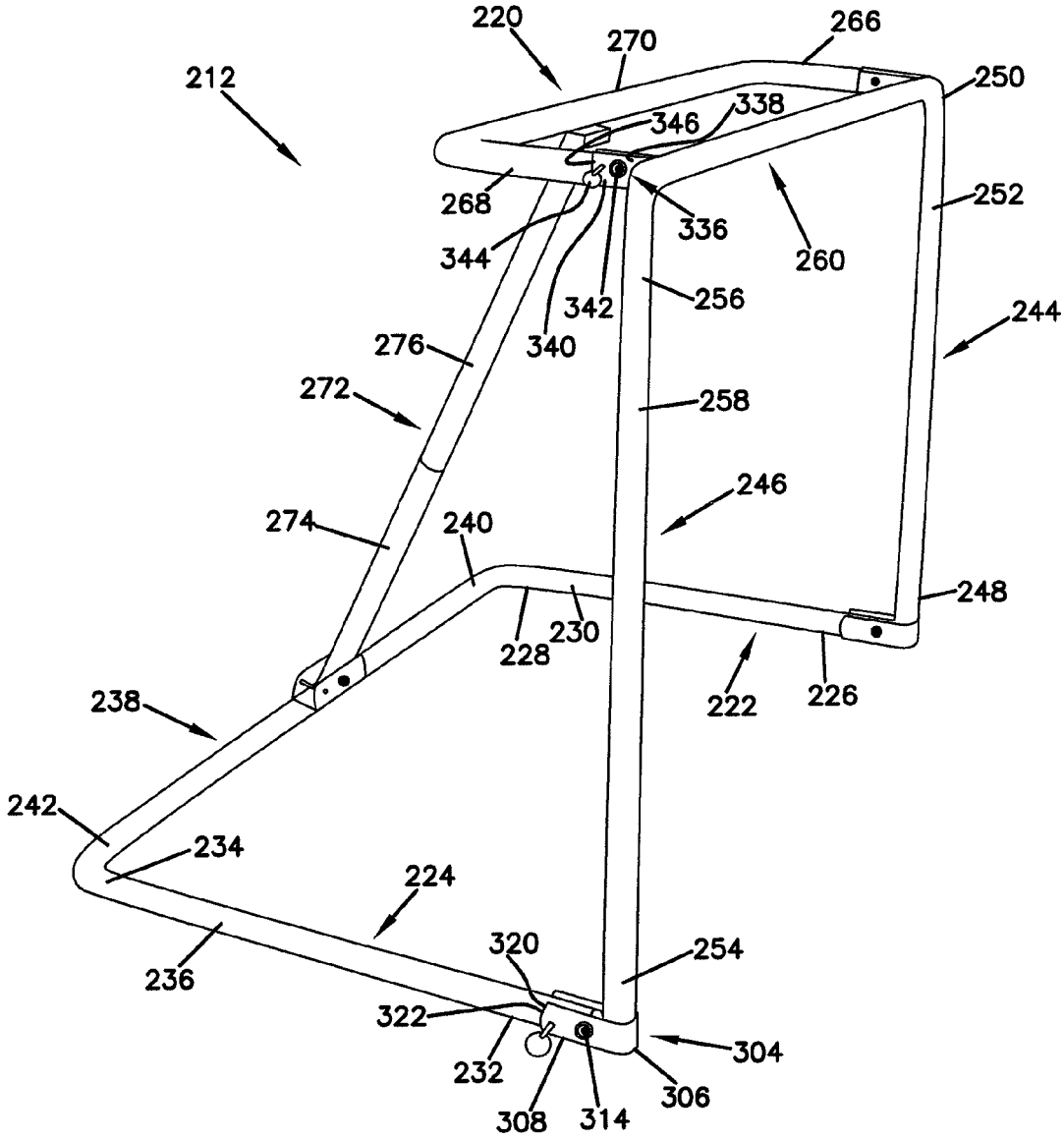
FIG. 8 is a perspective view of the frame assembly of FIG. 7.
Figure 9:
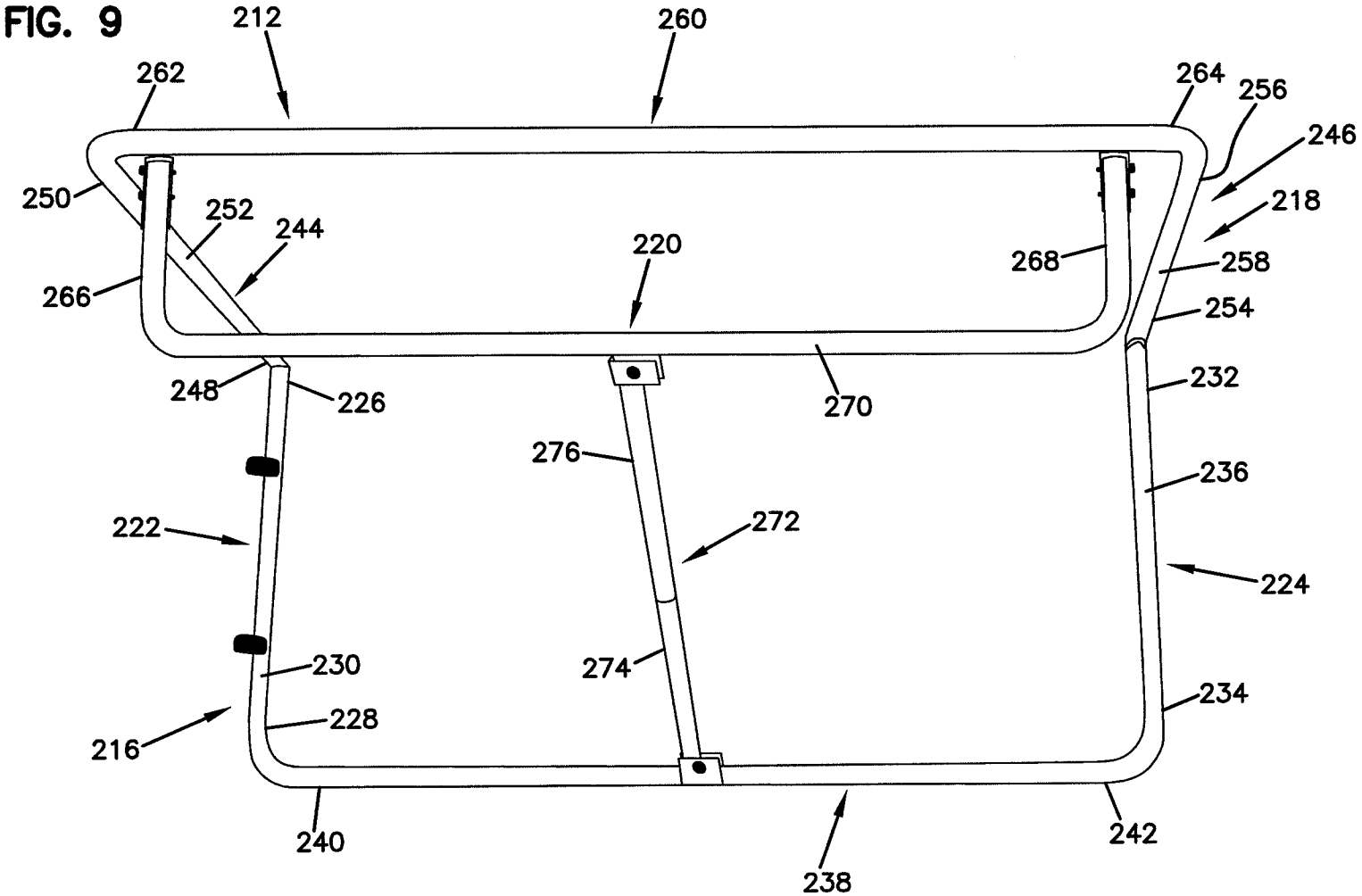
FIG. 9 is a top view of the frame assembly of FIG. 7.
Figure 10:
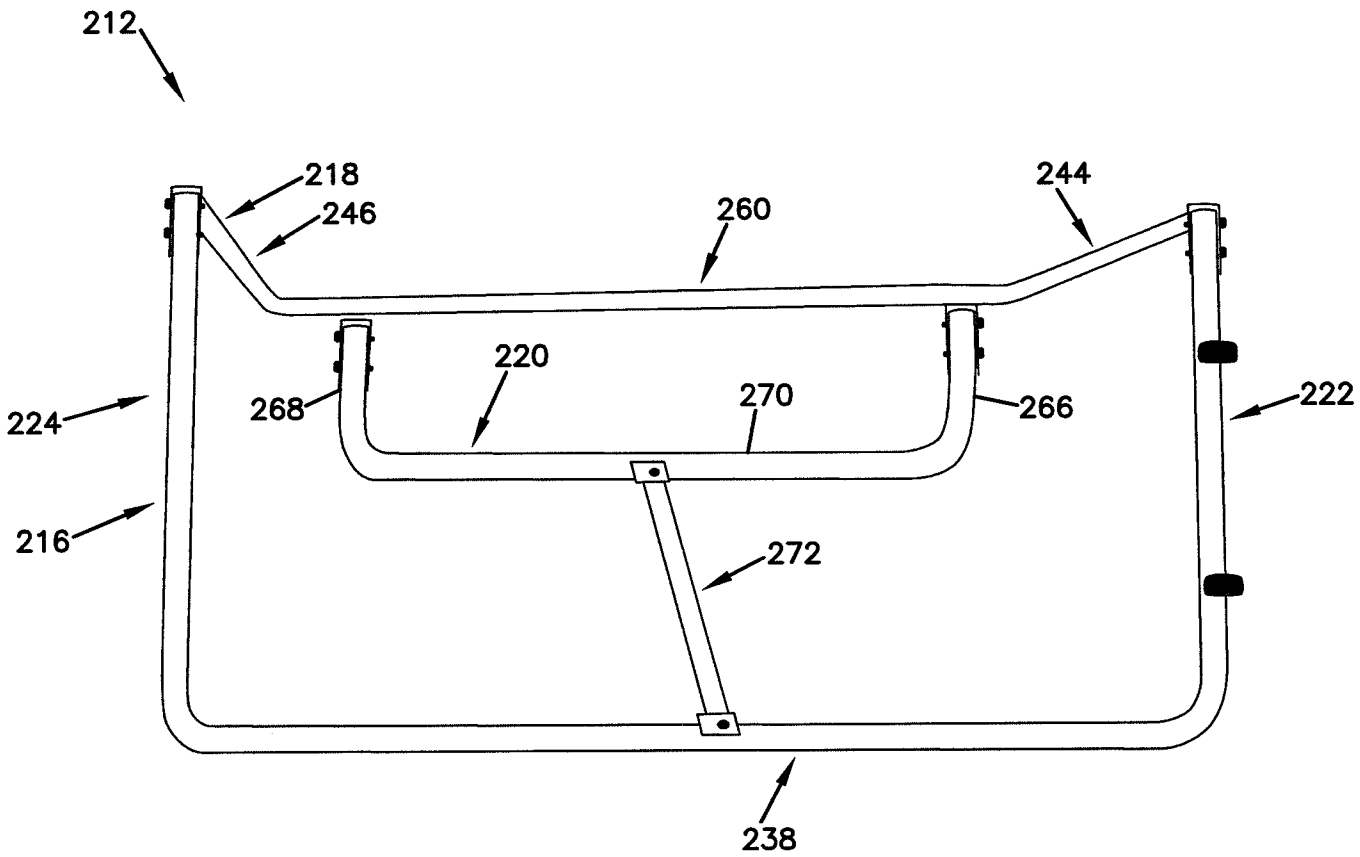
FIG. 10 is a bottom view of the frame assembly of FIG. 7.
Figure 11:
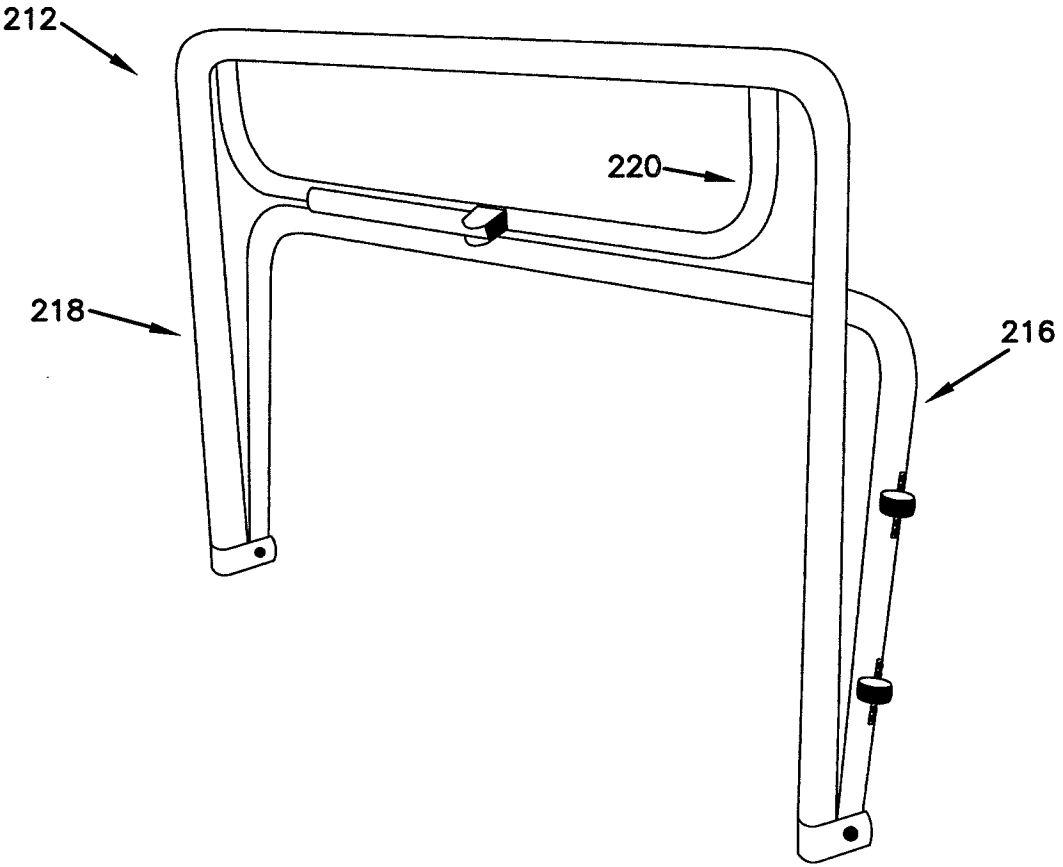
FIG. 11 is a perspective view of the frame assembly in a closed position.

Referring now to FIGS. 1 and 2, a goal assembly 10 is shown. The goal assembly 10 is adapted for use in sporting activities, such as hockey, soccer, etc. The goal assembly 10 includes a front opening through which a puck, ball, etc. can enter the goal assembly 10. The goal assembly 10 includes a frame assembly 12 and a net 14 attached to the frame assembly 12.

Referring now to FIGS. 3-6, the frame assembly 12 is shown. In the depicted embodiment, the frame assembly 12 is a non-foldable frame assembly 12. The frame assembly 12 includes a base frame 16, a main frame 18 and a shelf 20. In one embodiment, the frame assembly 12 is aluminum. In another embodiment, the frame assembly 12 is steel. In another embodiment, the frame assembly 12 is a plastic material (e.g., acrylonitrile butadiene styrene).

The base frame 16 is adapted for disposition on a generally horizontal surface (e.g., floor, ground, etc.). In the depicted embodiment, the base frame 16 is generally parallel to a portion of the surface on which it rests. The base frame 16 includes a first side rail 22 and a second side rail 24. In the depicted embodiment, the first and second side rails 22, 24 are generally parallel and define a distance D between the first and second side rails 22, 24. Each of the first and second side rails 22, 24 is generally cylindrical in shape. In the depicted embodiment, each of the first and second side rails 22, 24 is generally hollow.

The first side rail 22 includes a first axial end 26 and an oppositely disposed second axial end 28. The first side rail 22 further includes an outer surface 30 that extends from the first axial end 26 of the first side rail 22 to the second axial end 28.

The second side rail 24 includes a first axial end 32 and an oppositely disposed second axial end 34. The second side rail 24 further includes an outer surface 36 that extends from the first axial end 32 of the second side rail 24 to the second axial end 34.

The base frame 16 further includes a cross-member 38. The cross-member 38 spans the distance D between the first and second side rails 22, 24. In the depicted embodiment, the cross-member 38 is generally cylindrical in shape and generally hollow. The cross-member 38 includes a first axial end 40 and an oppositely disposed second axial end 42. The first axial end 40 of the cross-member 38 is engaged with the second axial end 28 of the first side rail 22 while the second axial end 42 of the cross-member 38 is engaged with the second axial end 34 of the second side rail 24. In the depicted embodiment, the cross-member 38 is integrally connected with the first and second side rails 22, 24.

Each of the first and second side rails 22, 24 has a length that is less than a length of the cross-member 38. In one embodiment, the length of each of the first and second side rails 22, 24 is less than or equal to 36 inches. In another embodiment, the length of each of the first and second side rails 22, 24 is less than or equal to 32 inches.

The main frame 18 is engaged to the base frame 16. The main frame 18 is engaged to the base frame 16 so that the main frame 18 extends outwardly from the base frame 16 in a generally vertical direction. In the depicted embodiment, the main frame 18 is engaged with the base frame 16 so that the main frame 18 is generally perpendicular to the base frame 16.

The main frame 18 includes a first side leg 44 and a second side leg 46. In the depicted embodiment, the first and second side legs 44, 46 are generally parallel and define a distance D2 between the first and second side legs 44, 46. In the depicted embodiment, the distance D2 between the first and second side legs 44, 46 of the main frame 18 is about equal to the distance D between the first and second side rails 22, 24 of the base frame 16. The first and second side legs 44, 46 are generally cylindrical in shape and are generally hollow.

The first side leg 44 includes a first end 48 and an oppositely disposed second end 50. The first side leg 44 further includes an outer surface 52 that extends from the first end 48 of the first side leg 44 to the second end 50. In the depicted embodiment, the first end 48 of the first side leg 44 is engaged (e.g., welded, fastened, etc.) to the first axial end 26 of the first side rail 22 of the base frame 16 so that the first side leg 44 extends in a generally upward direction relative to the first side rail 22.

The second side leg 46 includes a first end 54 and an oppositely disposed second end 56. The second side leg 46 further includes an outer surface 58 that extends from the first end 54 of the second side leg 46 to the second end 56. In the depicted embodiment, the first end 54 of the second side leg 46 is engaged (e.g., welded, fastened, etc.) to the first axial end 32 of the second side rail 24 of the base frame 16 so that the second side leg 46 extends in a generally upward direction relative to the second side rail 24.

The main frame 18 further includes a cross-bar 60. The cross-bar 60 spans the distance D2 between the first and second side legs 44, 46. In the depicted embodiment, the cross-bar 60 is generally cylindrical in shape and generally hollow. The cross-bar 60 includes a first end 62 and an oppositely disposed second end 64. The first end 62 of the cross-bar 60 is engaged with the second end 50 of the first side leg 44 while the second end 64 of the cross-bar 60 is engaged with the second end 56 of the second side leg 46. In one embodiment, the cross-bar 60 is integrally connected with the first and second side legs 44, 46. In another embodiment, the cross-bar 60 is removably engaged with the first and second side legs 44, 46.

The shelf 20 is adapted to support the net 14 and provide a larger interior volume of the goal assembly 10 when the net 14 is engaged to the frame assembly 12. The shelf 20 is engaged to the cross-bar 60 of the main frame 18 and is generally parallel to the base frame 16. In the depicted embodiment, the shelf 20 extends outwardly from the main frame 18 in a generally perpendicular direction.

The shelf 20 is generally U-shaped and includes a first end portion 66, a second end portion 68 and a body portion 70. The first and second end portions 66, 68 are engaged (e.g., fastened, welded, etc.) to the cross-bar 60 of the main frame 18. The first and second end portions 66, 68 are generally parallel. In the depicted embodiment, the first end portion 66 is generally parallel to the first side rail 22 and the second end portion 68 is generally parallel to the second side rail 24. In the depicted embodiment, a length of the first end portion 66 is less than a length of the first side rail 22 and a length of the second end portion 68 is less than a length of the second side rail 24.

The body portion 70 of the shelf 20 is generally parallel to the cross-bar 60 of the main frame 18. A length of the body portion 70 is less than or equal to a length of the cross-bar 60 of the main frame 18.

In the depicted embodiment, the frame assembly 12 includes a support bar 72. The support bar 72 extends between the cross-member 38 of the base frame 16 and the body portion 70 of the shelf 20. The support bar 72 includes a first end 74 that is engaged (e.g., fastened, welded, etc.) to the cross-member 38 of the base frame 16 and an oppositely disposed second end 76 that is engaged (e.g., fastened, welded, etc.) to the body portion 70 of the shelf 20.

The base frame 16, main frame 18, shelf 20 of the frame assembly 12 and the net 14 cooperatively define an interior 78 of the goal assembly 10. The main frame 18 defines an opening 80 to the interior 78 through which a puck or ball can enter the interior 78 of the goal assembly 10.

The goal assembly 10 defines a scoring plane. In the depicted embodiment, the scoring plane extends through the first and second side legs 44, 46 of the main frame 18.

Referring now to FIGS. 7-11, an alternate embodiment of a frame assembly 212 is shown. In the depicted embodiment, the frame assembly 212 is a foldable frame assembly. The frame assembly 212 includes a base frame 216, a main frame 218 and a shelf 220. Since the frame assembly 212 is foldable, the base frame 216, the main frame 218 and the shelf 220 are individual components that are pivotally engaged. As the base frame 216, main frame 218 and shelf 220 of the frame assembly 212 are structurally similar to the base frame 16, main frame 18 and shelf 20 of the frame assembly 12, respectively, the similar features will have the same reference numerals as the frame assembly 12 plus "200" while new features will have reference numerals greater than or equal to "300."

The base frame 216 includes a first side rail 222 and a second side rail 224. In the depicted embodiment, the first and second side rails 222, 224 are generally parallel.

The first side rail 222 includes a first axial end 226 and an oppositely disposed second axial end 228. The first side rail 222 further includes an outer surface 230 that extends from the first axial end 226 of the first side rail 222 to the second axial end 228.

The second side rail 224 includes a first axial end 232 and an oppositely disposed second axial end 234. The second side rail 224 further includes an outer surface 236 that extends from the first axial end 232 of the second side rail 224 to the second axial end 234.

The base frame 216 further includes a cross-member 238. The cross-member 238 is engaged to the first and second side rails 222, 224. The cross-member 238 includes a first axial end 240 and an oppositely disposed second axial end 242. The first axial end 240 of the cross-member 238 is engaged with the second axial end 228 of the first side rail 222 while the second axial end 242 of the cross-member 238 is engaged with the second axial end 234 of the second side rail 224.

The main frame 218 a first side leg 244 and a second side leg 246. In the depicted embodiment, the first and second side legs 244, 246 are generally parallel.

The first side leg 244 includes a first end 248 and an oppositely disposed second end 250. The first side leg 244 further includes an outer surface 252 that extends from the first end 248 of the first side leg 244 to the second end 250.

The second side leg 246 includes a first end 254 and an oppositely disposed second end 256. The second side leg 246 further includes an outer surface 258 that extends from the first end 254 of the second side leg 246 to the second end 256.

The main frame 218 further includes a cross-bar 260. The cross-bar 260 is engaged to the first and second side legs 244, 246. The cross-bar 260 includes a first end 262 and an oppositely disposed second end 264. The first end 262 of the cross-bar 260 is engaged with the second end 250 of the first side leg 244 while the second end 264 of the cross-bar 260 is engaged with the second end 256 of the second side leg 246.

The shelf 220 is generally U-shaped and includes a first end portion 266, a second end portion 268 and a body portion 270. The first and second end portions 266, 268 are generally parallel.

In the depicted embodiment, the base frame 216 is pivotally engaged with the main frame 218. The base frame 216 is adapted to pivot about a pivot axis 300 between an open (i.e., unfolded) position (shown in FIG. 7) and a closed (i.e., folded) position (shown in FIG. 11).

A first bracket 302 is engaged (e.g., fastened, welded, etc.) to the first end 248 of the first side leg 244 of the main frame 218 while a second bracket 304 is engaged (e.g., fastened, welded, etc.) to the first end 254 of the second side leg 246. Each of the first and second brackets 302, 304 includes a first axial end portion 306 and a second axial end portion 308 and defines a longitudinal axis 310 that extends through the first and second axial end portions 306, 308.

The first end 248 of the first side leg 244 of the main frame 218 is engaged to the first axial end portion 306 of the first bracket 302 while the first axial end 226 of the first side rail 222 of the base frame 216 is pivotally engaged to the second axial end portion 308 of the first bracket 302. In the depicted embodiment, the first side leg 244 extends outwardly from the first bracket 302 in a direction that is generally perpendicular to the longitudinal axis 310 of the first bracket 302. In the open position, the first side rail 222 is generally coaxial with the longitudinal axis 310 of the first bracket 302.

The first end 254 of the second side leg 246 of the main frame 218 is engaged to the first axial end 306 of the second bracket 304 while the first axial end 232 of the second side rail 224 of the base frame 216 is pivotally engaged to the second axial end 308 of the second bracket 304. In the depicted embodiment, the second side leg 246 extends outwardly from the second bracket 304 in a direction that is generally perpendicular to the longitudinal axis 310 of the second bracket 304. In the open position, the second side rail 224 is generally coaxial with the longitudinal axis 310 of the second bracket 304.

In the depicted embodiment, the pivotal engagement of the first bracket 302 to the first side rail 222 and the second bracket 304 to the second side rail 224 is provided by a first pin 312 that extends through a hole in the second axial end portion 308 of the first bracket 302 and a hole in the first axial end 226 of the first side rail 222 and a second pin 314 that extends through a hole in the second axial end portion 308 of the second bracket 304 and a hole in the first axial end 232 of the second side rail 224. In the depicted embodiment, a central axis of the hole in the second axial end portion 308 of the first bracket 302 is generally perpendicular to the longitudinal axis 310 of the first bracket 302 and a central axis of the hole in the second axial end portion 308 of the second bracket 304 is generally perpendicular to the longitudinal axis 310 of the second bracket 304.

In the depicted embodiment, a first locking member 316 is adapted to engage the first side rail 222 when the base frame 216 is in the open position. The first locking member 316 extends through the second axial end portion 308 of the first bracket 302 and into a hole disposed through the outer surface 230 of the first side rail 222. The first locking member 316 is positioned between the first pin 312 and an end surface 318 of the second axial end 308 of the first bracket 302. In the depicted embodiment, the first locking member 316 is a pin.

In the depicted embodiment, a second locking member 320 is adapted to engage the second side rail 224 when the base frame 216 is in the open position. The second locking member 320 extends through the second axial end portion 308 of the second bracket 304 and into a hole disposed through the outer surface 236 of the second side rail 224. The second locking member 320 is positioned between the second pin 314 and an end surface 322 of the second axial end 308 of the second bracket 304. In the depicted embodiment, the second locking member 320 is a pin.

The shelf 220 is pivotally engaged to the cross-bar 260 of the main frame 218. In the depicted embodiment, the first end portion 266 of the shelf 220 is pivotally engaged to the cross-bar 260 at a location that is adjacent to the first end 262 of the cross-bar 260 and the second end portion 268 of the shelf 220 is pivotally engaged to the cross-bar 260 at a location that is adjacent to the second end 264 of the cross-bar 260. The shelf 220 is adapted to pivot between an open (i.e., unfolded) position (shown in FIG. 7) and a closed (i.e., folded) position (shown in FIG. 11).

A third bracket 324 provides the pivotal engagement of the first end portion 266 of the shelf 220 and the cross-bar 260. The third bracket 324 includes a first axial end portion 326 that is engaged to the shelf 220 and a second axial end portion 328 that extends outwardly from the cross-bar 260 in a direction that is generally perpendicular to the cross-bar 260. The second axial end portion 328 of the third bracket 324 receives the first end portion 266 of the shelf 220. The first end portion 266 of the shelf 220 pivots about a third pin 330 that extends through a hole in the second axial end portion 328 of the third bracket 324 and through a hole in the first end portion 266 of the shelf 220.

In the depicted embodiment, a third locking member 332 is adapted to engage the first end portion 266 when the shelf 220 is in the open position. The third locking member 332 extends through the second axial end portion 328 of the third bracket 324 and into a hole disposed through the first end portion 266 of the shelf 220. The third locking member 332 is positioned between the third pin 330 and an end surface 334 of the second axial end portion 328 of the third bracket 324. In the depicted embodiment, the third locking member 332 is a pin.

A fourth bracket 336 provides the pivotal engagement of the second end portion 268 of the shelf 220 and the cross-bar 260. The fourth bracket 336 includes a first axial end portion 338 that is engaged to the shelf 220 and a second axial end portion 340 that extends outwardly from the cross-bar 260 in a direction that is generally perpendicular to the cross-bar 260. The second axial end portion 340 of the fourth bracket 336 receives the second end portion 268 of the shelf 220. The second end portion 268 of the shelf 220 pivots about a fourth pin 342 that extends through a hole in the second axial end portion 340 of the fourth bracket 336 and through a hole in the second end portion 268 of the shelf 220.

In the depicted embodiment, a fourth locking member 344 is adapted to engage the second end portion 268 when the shelf 220 is in the open position. The fourth locking member 344 extends through the second axial end portion 340 of the fourth bracket 336 and into a hole disposed through the second end portion 268 of the shelf 220. The fourth locking member 344 is positioned between the fourth pin 342 and an end surface 346 of the second axial end portion 340 of the fourth bracket 336. In the depicted embodiment, the fourth locking member 344 is a pin.

The frame assembly 212 further includes a support bar 272. The support bar 272 extends between the cross-member 238 of the base frame 216 and the body portion 270 of the shelf 220. The support bar 272 includes a first bar 274 that is pivotally engaged to the cross-member 238 of the base frame 216 and a second bar 276 that is pivotally engaged to the body portion 270 of the shelf 220. The first and second bars 274, 276 are connected when the frame assembly 212 is in the open position and disconnected when the frame assembly 212 is in the closed position.

Figure 12:
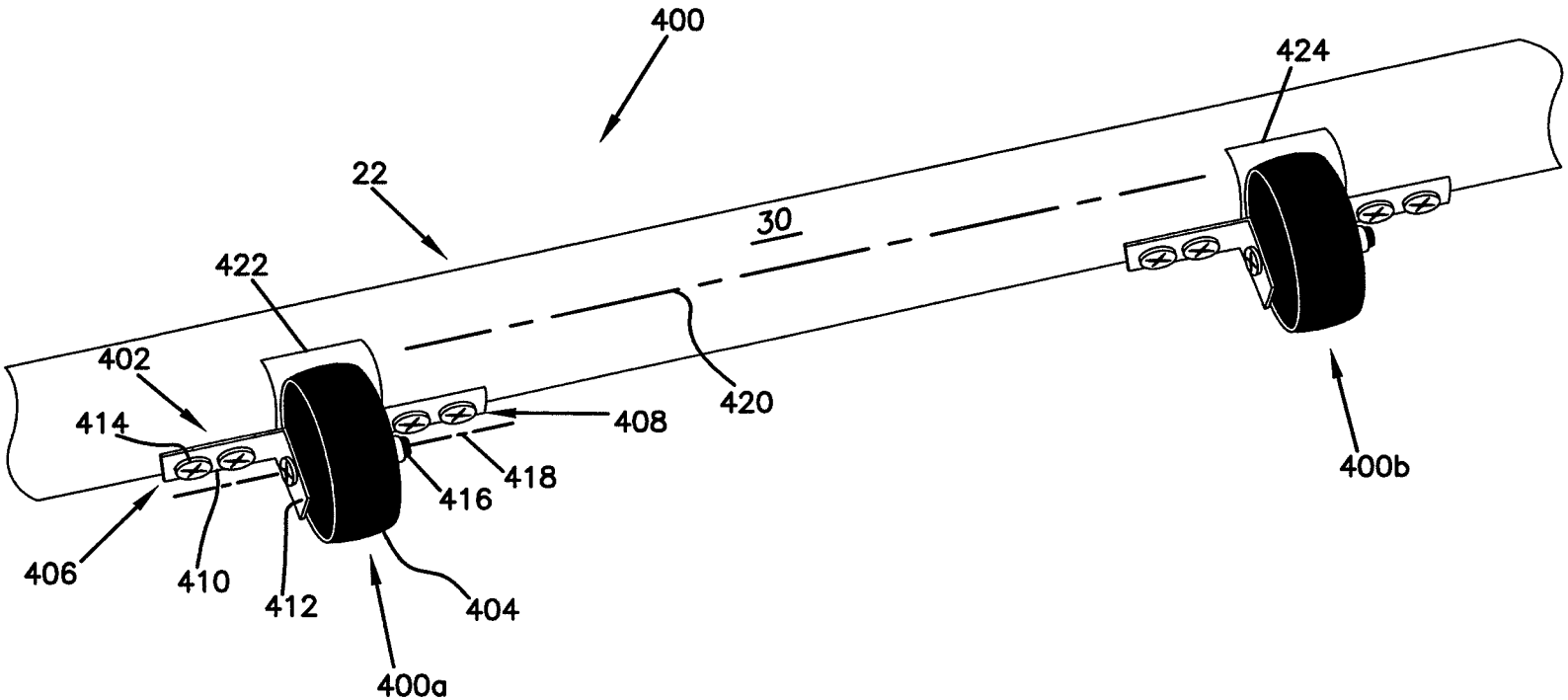
FIG. 12 is an enlarged fragmentary perspective view of a wheel assembly suitable for use with the frame assemblies of FIGS. 3 and 7.

Referring now to FIG. 12, a wheel assembly 400 is shown. While the wheel assembly 400 can be used with either of the frame assemblies 12, 212 described, it will be described with regard to the frame assembly 12 for ease of description purposes.

In the depicted embodiment, the wheel assembly 400 includes a first wheel assembly 400*a* and a second wheel assembly 400*b*. Each of the first and second wheel assemblies 400*a*, 400*b* includes a mounting bracket assembly 402 and a wheel 404 engaged to the mounting bracket assembly 402 so that the wheel 404 can rotate.

The mounting bracket assembly 402 includes a first mounting bracket 406 and a second mounting bracket 408. In the depicted embodiment, the first and second mounting brackets 406, 408 are generally L-shaped. Each of the first and second mounting brackets 406, 408 includes a first portion 410 and a second portion 412. The first portion 410 is configured to engage the first side rail 22 of the base frame 16. The first portion 410 includes a plurality of holes that is adapted to receive a plurality of fasteners 414 (e.g., screw, rivet, etc.). Each fastener 414 extends through the first portion 410 and into the first side rail 22. In the depicted embodiment, each fastener 414 is in threaded engagement with the first side rail 22.

The second portion 412 of the first and second mounting brackets 406, 408 extends outwardly from the corresponding first portion 410. In the depicted embodiment, the second portion 412 extends outwardly from the first portion 410 in a generally perpendicular direction. The second portions 412 of each of the first and second mounting brackets 406, 408 are adapted to engage the wheel 404. The second portion 412 of the first mounting bracket 406 defines a first hole while the second portion 412 of the second mounting bracket 406 defines a second hole. The first portions 410 of the first and second mounting brackets 406, 408 are mounted to the first side rail 22 so that the first and second holes of the second portions 412 of the first and second mounting brackets 406, 408 are aligned.

A wheel axle 416 extends through the first and second holes in the second portions 412 of the first and second mounting brackets 406, 408. In the depicted embodiment, the wheel axle 416 is a fastener (e.g., screw, rivet, etc.). The wheel axle 416 defines a rotation axis 418 about which the wheel 404 rotates. The rotation axis 418 is generally parallel with the first side rail 22 so that the rotation axis 418 is generally parallel to a central longitudinal axis 420 of the first side rail 22. In another embodiment, the rotation axis 418 is generally perpendicular to the scoring plane of the frame assembly 12.

The wheel 404 includes an outer diameter. In the depicted embodiment, a radius of the wheel 404 is greater than a distance from the outer surface 30 of the first side rail 22 to the rotation axis 418. In order to avoid interference between the wheels 404 of the first and second wheel assemblies 400*a*, 400*b* and the outer surface 30 of the first side rail 22, the outer surface 30 of the first side rail 22 defines a first slot 422 disposed adjacent to the first axial end 26 and a second slot 424 disposed adjacent to the second axial end 28 of the first side rail 22. The first slot 422 is configured to receive a portion of the wheel 404 of the first wheel assembly 400*a* while the second slot 424 is configured to receive a portion of the wheel 404 of the second wheel assembly 400*b*. Each of the first and second slots 422, 424 has a width that is greater than a width of the wheel 404.

The first and second wheel assemblies 400*a*, 400*b* are engaged with the first side rail 22 of the base frame 16 so that when the base frame 16 is resting on a playing surface, the wheels 404 are not in contact with the playing surface.

In another embodiment, the distance from the central longitudinal axis 420 to the outer surface 30 of the first side rail 22 is greater than a distance from the central longitudinal axis 420 to the rotation axis 418 of the wheel 404. In this alternate embodiment, the rotation axis 418 is disposed within an inner passage of the first side rail 22.

Referring now to FIGS. 1 and 12, a method for moving the goal assembly 10 will be described. With the base frame 16 of the goal assembly 10 resting on a playing surface, the goal assembly 10 is pivoted about the first side rail 22 of the base frame 16 until the wheels 404 of the first and second wheel assemblies 400*a*, 400*b* support the goal assembly 10. In one embodiment, the first side leg 44 of the main frame 18 can be grasped by the mover for pivoting the goal assembly 10 about the first side rail 22.

With the goal assembly 10 disposed on the first and second wheel assemblies 400*a*, 400*b*, the goal assembly 10 can be pushed to a desired location. As the goal assembly 10 is pushed, the wheels 404 of the first and second wheel assemblies 400*a*, 400*b* rotate about their respective rotation axes 418 to provide rolling contact between the goal assembly 10 and the playing surface.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A goal assembly comprising:

a base frame forming a planar support surface, the base frame having:

a first side rail;

a second side rail that is generally parallel to the first side rail;

a cross-member engaged to the first and second side rails;

a main frame engaged to the base frame and extending in a generally upward direction, the main frame having:

a first side leg engaged to the first side rail;

a second side leg engaged to the second side rail;

a cross-bar engaged to the first and second side legs;

a first wheel assembly engaged to the first side rail, the first wheel assembly having a wheel that rotates about a rotation axis of the first wheel assembly; and a second wheel assembly engaged to the first side rail, the second wheel assembly having a wheel that rotates about a rotation axis of the second wheel assembly, wherein the rotation axes of the first and second wheel assemblies are generally parallel to the first side rail;

wherein when the base frame is positioned with the planar support surface engaged with the ground, the first and second wheel assemblies are spaced from the ground and wherein rotation of the base frame about an axis parallel to the first side rail causes the wheels of the first and second wheel assemblies to contact the ground.

2. The goal assembly of claim 1, further comprising a net engaged to the base frame and the main frame.

3. The goal assembly of claim 1, further comprising a shelf engaged to cross-bar of the main frame, the shelf having a first end portion, a second end portion that is generally parallel to the first end portion and a body portion that extends between the first and second end portions, wherein the body portion is generally parallel to the cross-bar of the main frame.

4. The goal assembly of claim 3, further comprising a support bar that extends between the cross-member of the base frame and the body portion of the shelf.

5. The goal assembly of claim 3, wherein the shelf is pivotally engaged to the cross-bar of the main frame.

6. The goal assembly of claim 1, wherein the base frame is pivotally engaged to the main frame.

7. The goal assembly of claim 1, wherein the first side rail defines a first slot and a second slot, the wheels of the first and second wheel assemblies being at least partially disposed in the first and second slots, respectively.

8. The goal assembly of claim 7, wherein the rotation axis of each of the first and second wheel assemblies is disposed outside of an outer surface of the first side rail.

9. A goal assembly comprising:

a base frame forming a planar support surface, the base frame having:

a first side rail;

a second side rail that is generally parallel to the first side rail;

a cross-member engaged to the first and second side rails;

a main frame engaged to the base frame and extending in a generally perpendicular direction to the base frame, the main frame having:

a first side leg engaged to the first side rail;

a second side leg engaged to the second side rail;

a cross-bar engaged to the first and second side legs;

a shelf engaged to cross-bar of the main frame, the shelf having a first end portion, a second end portion that is generally parallel to the first end portion and a body portion that extends between the first and second end portions, wherein the body portion is generally parallel to the cross-bar of the main frame;

a net engaged to the base frame and the main frame;

a first wheel assembly engaged to the first side rail, the first wheel assembly having a wheel that rotates about a rotation axis of the first wheel assembly; and a second wheel assembly engaged to the first side rail, the second wheel assembly having a wheel that rotates about a rotation axis of the second wheel assembly, wherein the rotation axes of the first and second wheel assemblies are generally parallel to the first side rail;

wherein when the base frame is positioned with the planar support surface engaged with the ground, the first and second wheel assemblies are spaced from the ground and wherein rotation of the base frame about an axis parallel to the first side rail causes the wheels of the first and second wheel assemblies to contact the ground.

10. The goal assembly of claim 9, further comprising a support bar that extends between the cross-member of the base frame and the body portion of the shelf.

11. The goal assembly of claim 9, wherein the shelf is pivotally engaged to the cross-bar of the main frame.

12. The goal assembly of claim 9, wherein the base frame is pivotally engaged to the main frame.

13. The goal assembly of claim 9, wherein the first side rail defines a first slot and a second slot, the wheels of the first and second wheel assemblies being at least partially disposed in the first and second slots, respectively.

14. The goal assembly of claim 13, wherein the rotation axis of each of the first and second wheel assemblies is disposed outside of an outer surface of the first side rail.

15. A goal assembly comprising:

a main frame, the main frame having:

a first side leg;

a second side leg being parallel to the first side leg, wherein the first and second side legs define a scoring plane;

a cross-bar engaged to the first and second side legs;

a base frame forming a planar support surface, the base frame pivotally engaged to the main frame and adapted to pivot between an open position and a closed position, the base frame having:

a first side rail engaged to the first side leg;

a second side rail engaged to the second side leg, the second side rail being generally parallel to the first side rail;

a cross-member engaged to the first and second side rails;

a shelf pivotally engaged to the cross-bar of the main frame and adapted to pivot between an open position and a closed position, the shelf having a first end portion, a second end portion that is generally parallel to the first end portion and a body portion that extends between the first and second end portions, wherein the body portion is generally parallel to the cross-bar of the main frame;

a net engaged to the base frame and the main frame;

a first wheel assembly engaged to the first side rail, the first wheel assembly having a wheel that rotates about a rotation axis of the first wheel assembly; and a second wheel assembly engaged to the first side rail, the second wheel assembly having a wheel that rotates about a rotation axis of the second wheel assembly, wherein the rotation axes of the first and second wheel assemblies are generally perpendicular to the scoring plane;

wherein when the base frame is in an open position and positioned with the planar support surface engaged with the ground, the first and second wheel assemblies are spaced from the ground and wherein rotation of the base frame about an axis parallel to the first side rail causes the wheels of the first and second wheel assemblies to contact the ground.

16. The goal assembly of claim 15, further comprising a support bar that extends between the cross-member of the base frame and the body portion of the shelf.

17. The goal assembly of claim 16, wherein the support bar is removable.

18. The goal assembly of claim 16, wherein the support bar includes a first bar pivotally engaged to the cross-member of the base frame and a second bar pivotally engaged to the body portion of the shelf, wherein the first and second bars are connected when the base frame and the shelf are in the open positions.

19. The goal assembly of claim 15, wherein the first side rail defines a first slot and a second slot, the wheels of the first and second wheel assemblies being at least partially disposed in the first and second slots, respectively.

20. The goal assembly of claim 19, wherein the rotation axis of each of the first and second wheel assemblies is disposed outside of an outer surface of the first side rail.

21. A goal assembly comprising:

a frame assembly including:

a base frame forming a planar support surface a first side leg;

a second side leg being parallel to the first side leg, wherein the first and second side legs define a scoring plane;

a cross-bar engaged to the first and second side legs;

a first wheel assembly engaged to a first side rail of the base frame, the first wheel assembly having a wheel that rotates about a rotation axis of the first wheel assembly; and a second wheel assembly engaged to the first side rail of the base frame, the second wheel assembly having a wheel that rotates about a rotation axis of the second wheel assembly, wherein the rotation axes of the first and second wheel assemblies are generally perpendicular to the scoring plane;

wherein when the frame assembly is positioned with the planar support surface engaged with the ground, the first and second wheel assemblies are spaced from the ground and wherein rotation of the frame assembly about an axis parallel to the first side rail causes the wheels of the first and second wheel assemblies to contact the ground.

22. A method of using a goal assembly comprising:

a) providing a goal assembly including:

i) a base frame having:

a first side rail;

a second side rail;

a cross-member engaged to the first and second side rails;

ii) a main frame engaged to the base frame and extending in a generally perpendicular direction to the base frame, the main frame having:

a first side leg engaged to the first side rail;

a second side leg engaged to the second side rail;

a cross-bar engaged to the first and second side legs;

iii) a shelf engaged to cross-bar of the main frame, the shelf having a first end portion, a second end portion and a body portion that extends between the first and second end portions;

iv) a net engaged to the base frame and the main frame;

v) a first wheel assembly engaged to the first side rail, the first wheel assembly having a wheel that rotates about a rotation axis of the first wheel assembly; and vi) a second wheel assembly engaged to the first side rail, the second wheel assembly having a wheel that rotates about a rotation axis of the second wheel assembly, wherein the rotation axes of the first and second wheel assemblies are generally parallel to the first side rail;

wherein when the first side rail, the second side rail and the cross-member are parallel to the ground, the first and second wheel assemblies are spaced from the ground;

b) rotating the goal assembly about an axis parallel to the first side rail until the wheel of the first wheel assembly and the wheel of the second wheel assembly support the goal assembly on the ground;

c) moving the rotated goal assembly with movement caused by a force applied to the goal assembly to cause the wheel of the first wheel assembly and the second wheel of the second wheel assembly to roll with respect to the ground.

23. A sports equipment support comprising:

a base frame having a first tubular rail;

a first wheel assembly engaged to the first tubular rail, the first wheel assembly having a wheel that rotates about a rotation axis of the first wheel assembly; and a second wheel assembly engaged to the first tubular rail, the second wheel assembly having a wheel that rotates about a rotation axis of the second wheel assembly, wherein the rotation axes of the first and second wheel assemblies are generally parallel to the first tubular rail, wherein the first tubular rail defines a first slot and a second slot, the wheels of the first and second wheel assemblies being at least partially disposed in the first and second slots, respectively;

wherein the rotation axis of each of the first and second wheel assemblies is disposed outside of an outer surface of the first tubular rail.

24. The sports equipment support of claim 23, further comprising:

a second tubular rail that is generally parallel to the first tubular rail;

a cross-member engaged to the first and second tubular rails, the first and second tubular rails and the cross-member forming the base frame defining a planar support surface;

wherein when the base frame is positioned on the ground with the planar support surface engaged with the ground, the first and second wheel assemblies are spaced from the ground.

25. The sports equipment support of claim 23, further comprising:

a second tubular rail that is generally parallel to the first tubular rail;

a cross-member engaged to the first and second tubular rails, the first and second tubular rails and the cross-member forming the base frame defining a planar support surface;

wherein when the base frame is positioned on the ground with the planar support surface engaged with the ground, the first and second wheel assemblies are spaced from the ground.

26. A sports equipment support comprising:

a base frame having a first tubular rail;

a first wheel assembly engaged to the first tubular rail, the first wheel assembly having a wheel that rotates about a rotation axis of the first wheel assembly; and a second wheel assembly engaged to the first tubular rail, the second wheel assembly having a wheel that rotates about a rotation axis of the second wheel assembly, wherein the rotation axes of the first and second wheel assemblies are generally parallel to the first tubular rail, a second tubular rail that is generally parallel to the first tubular rail;

a cross-member engaged to the first and second tubular rails, the first and second tubular rails and the cross-member forming the base frame defining a planar support surface;

wherein when the base frame is positioned on the ground with the planar support surface engaged with the ground, the first and second wheel assemblies are spaced from the ground;

wherein the first tubular rail defines a first slot and a second slot, the wheels of the first and second wheel assemblies being at least partially disposed in the first and second slots, respectively.

27. The sports equipment support of claim 26, further comprising:

a main frame engaged to the base frame and extending in a generally upward direction, the main frame having:

a first side leg engaged to the first side rail;

a second side leg engaged to the second side rail;

a cross-bar engaged to the first and second side legs;

a net engaged to the base frame and the main frame;

wherein the base frame, the main frame and the net define a sports goal with an open front.

28. The sports equipment support of claim 26, further comprising a main frame engaged to the base frame and extending in a generally upward direction.

29. A method of using a sports equipment comprising:

a) providing a sports equipment including:

i) a base frame having:

a first rail;

a second rail;

a cross-member engaged to the first and second rails;

ii) a first wheel assembly engaged to the first rail, the first wheel assembly having a wheel that rotates about a rotation axis of the first wheel assembly; and iii) a second wheel assembly engaged to the first rail, the second wheel assembly having a wheel that rotates about a rotation axis of the second wheel assembly, wherein the rotation axes of the first and second wheel assemblies are generally parallel to the first rail;

wherein when the first rail, the second rail and the cross-member are parallel to the ground, the first and second wheel assemblies are spaced from the ground, wherein the first rail defines a first slot and a second slot, the wheels of the first and second wheel assemblies being at least partially disposed in the first and second slots, respectively;

b) rotating the sports equipment about an axis parallel to the first rail until the wheel of the first wheel assembly and the wheel of the second wheel assembly support the sports equipment on the ground;

c) moving the rotated sports equipment with movement caused by a force applied to the sports equipment to cause the wheel of the first wheel assembly and the second wheel of the second wheel assembly to roll with respect to the ground.

* * * * *